US005400478A

United States Patent [19]

Levinsohn et al.

[11] Patent Number: 5,400,478

[45] Date of Patent: Mar. 28, 1995

[54] COMFORTER COVER CLIPS

[76] Inventors: Adam Levinsohn; David Baron, both of c/o Levinsohn Textile Co., 358 Fifth Ave., New York, N.Y. 10001

[21] Appl. No.: 69,022

[22] Filed: May 28, 1993

[51] Int. Cl.[6] ..... A47C 21/00

[52] U.S. Cl. ..... 24/72.5; 24/503; 24/523; 5/496

[58] Field of Search ..... 24/72.5, 20 W, 601.4, 24/523, 30.5 P, 562, 543; 248/74.3; 5/470, 494, 496, 498

[56] References Cited

U.S. PATENT DOCUMENTS

| | | | |
|---|---|---|---|
| 644,894 | 3/1900 | Carlin | 24/503 |
| 2,022,169 | 11/1935 | Yamashiro | 24/72.5 |
| 2,423,222 | 7/1947 | Berry | 248/74.3 |
| 2,455,598 | 12/1948 | Michalenko | 248/74.3 |
| 2,772,460 | 12/1956 | Berkowicz et al. | 24/72.5 |
| 2,931,055 | 4/1960 | Sostrin | 5/496 |
| 2,988,759 | 6/1961 | Gerdes | 24/72.5 |
| 3,296,668 | 1/1967 | Aiken | 24/72.5 |
| 3,546,725 | 12/1970 | Tambascio | 5/200.1 |
| 4,520,518 | 6/1985 | Reaser | 24/72.5 |
| 4,793,030 | 12/1988 | Hirsch | 24/543 |

FOREIGN PATENT DOCUMENTS

| | | | |
|---|---|---|---|
| 0647991 | 12/1928 | France | 24/72.5 |

*Primary Examiner*—Victor N. Sakran
*Attorney, Agent, or Firm*—Robert W. Fiddler

[57] ABSTRACT

A clip and method of using same to facilitate the positioning of a cover of the typical rectangular bag-like type over a typical rectangular bedding item such as a blanket, quilt, comforter or the like. The clip is formed with two opposed selectively engageable jaws dimensioned to permit engagement of the corners of the bedding item and cover therebetween. The clip is formed with a padded cover overlying the outside surfaces of the clip. In use, the cover typically formed with a closed end and an open end is turned inside out and positioned so that the closed corners of the inside out bag lie adjacent the corners of the bedding item. These adjacent corners of the cover and bedding item are then clipped together using one clip at each corner. The cover is then drawn over the bedding item to turn the cover right side out and simultaneously enclose the bedding item. The free corners of the cover and bedding item may if desired be clipped together, preferably within the cover.

8 Claims, 1 Drawing Sheet

COMFORTER COVER CLIPS

This invention relates to the art of bedding and more particularly to an improved clip and method for implementing the positioning of a bedding item such as a comforter, quilt or blanket in a cover of the bag-like type generally employed to enclose and protect such bedding items.

BACKGROUND OF INVENTION

Covers have long been employed in connection with bedding items such as quilts, blankets, comforters, duvets and the like to enclose and protect such bedding items. Such covers are generally made of a sheet like easily launderable material sewn into a bag dimensioned to accommodate one of the aforementioned bedding items. The use of such covers serves to minimize required laundering and/or dry cleaning of the bedding item, and often serves to provide a decorative facade for the item. Thus, relatively bulky and hard to clean bedding items such as feather blankets or comforters can be enclosed in a cover which can readily be removed for laundering at frequent intervals as desired, while the covered bedding item will require cleaning at relatively infrequent intervals.

Problems arise in positioning the cover over the bedding item. Thus, the typical cover is formed of two rectangular sheets formed of a conventional textile sheeting material such as woven cotton, linen, synthetic fibers and combinations thereof. This sheet material is sewn into a rectangular bag closed along three sides and open at one end. In use, the blanket or like bedding item has to be manipulated into the open end of the bag forming the cover. This can be done by sliding one edge of the bedding item into the opening up to the closed end of the bag, gripping the corners of the cover and blanket in the cover and smoothing the blanket out inside the cover to match the corners of the blanket with the corners of the cover. This often proves difficult resulting in a bunching of the blanket in the cover. Alternatively, the cover may be turned inside out width the interior corners remote from the cover opening positioned over the blanket corners which are intended to lie at these corners in the cover, and thereafter turning the cover right side out by sliding the cover down over the blanket while holding the corners which have previously been positioned. This too presents manipulative problems and does not avoid bunching.

Attempts have been made in the past to minimize the above problems by providing some sort of retaining element for holding a cover in position with respect to the bedding item.

Thus, Sussman in U.S. Pat. No. 2,183,360 discloses a quilt cover formed with button holes designed to receive buttons sewn to the upper edge of the quilt so that the buttons on the quilt can be engaged with the buttonholes and the cover to retain the covered quilt in desired position.

Belsky in U.S. Pat. No. 2,505,027 discloses what he describes as an improvement in use of buttons and buttonholes, safety pins, and snaps residing in the provision of clips held by snaps inside the cover with the clip employed to engage a blanket positioned in the cover.

Picon in U.S. Pat. No. 2,737,667 discloses a clip for holding a blanket cover in position ion a blanket in which the clip is clipped over the outside corners of the cover when the blanket is positioned therein to maintain the desired corner orientation of the blanket within the cover.

Aiken in U.S. Pat. No. 3,296,668 discloses a clip which serves to secure a sheet in position on a bed in a smooth orientation.

Yamashiro in U.S. Pat. No. 2,022,169 discloses a bedding clamp for retaining a top sheet in position between a blanket and the bed occupant.

These previously developed clips, button and buttonhole arrangements, snaps or other fastening arrangements have proven unwieldy and have not come into common usage. It is believed that these prior fastening arrangements have proven undesirable because they either require specific pairing of the cover with the bedding item as in the case of mating snaps, zippers, buttons and buttonholes or the like so that a specific cover structure is required for the bedding item which has been formed with a button, snap or zipper half intended to match with the corresponding part on the cover. Where previously evolved clips had been employed, such clips on the exterior of the cover abrade the adjacent linen on the bed and often scratch the occupant.

It is with the above considerations in mind that the present improved bedding clip and method of employing the clip to facilitate positioning of a cover on a bedding item such as a blanket, quilt, comforter or duvet has been evolved serving to insure desired positioning of the corners of the bedding item in the interior corners of the cover without interfering with desired smoothness of the covered bedding item or increasing any wear and tear on the assembled cover and bedding item.

It is accordingly a primary object of this invention to provide means for retaining a bedding item such as a blanket, quilt or comforter in a desired orientation within a cover for said bedding item with the corners of the bedding item maintained at a desired position within the cover.

A further object of the invention is to provide an improved clip for engaging a bedding item with respect to a cover which when in use is not exposed to the user of the covered bedding item so as to eliminate the possibility of scratching of the user.

Another object of the invention is to provide an improved clip for maintaining a cover with respect to a bedding item in which the clip has a minimal abrasive effect on the assembled cover and bedding item.

An additional object of the invention is to provide an improved method for positioning a cover over a bedding item which facilitates desired orientation of the bedding item in the cover.

These and other objects of the invention which will become hereafter apparent are achieved by providing a clip formed with jaws having padding on the exterior surfaces thereof. In use, a conventional bedding cover of a rectangular bag-like configuration employed to enclose bedding items such as quilts, blankets, comforters and the like is turned inside out, and laid over the bedding item with the corners of the cover aligned with the corners of the bedding item. The interior or closed corners of the everted cover are secured to the corners of the bedding by clipping the cover and bedding corners between the jaws of the clips. Thereafter, the cover is brought down over the bedding item to bring the desired exterior surface of the cover to the outside, thus leaving the clipped corners engaged inside the cover. If desired, the remaining corners of the cover and bedding item may be clipped together, preferably within the cover.

A feature of the invention resides in the fact that the padding on the clips prevents the clips from abrading either the cover or the bedding and further minimizes the possibility of any hard points or corners interfering with the comfort of a sleeper.

Another feature of the invention resides in the fact that the clips facilitate the positioning and maintenance of a cover on an item of bedding such as a blanket or comforter by insuring the orientation of the corners of the bedding items in desired position with respect to the corners of the cover.

BRIEF DESCRIPTION OF DRAWINGS

The specific details of a preferred embodiment of the invention will be described in clear concise and exact terms, setting forth the best mode contemplated by applicant for practicing the invention, so as to enable any person skilled in the art to practice the invention, in conjunction with the accompanying drawings, wherein.

DESCRIPTION OF PREFERRED EMBODIMENT

Referring now more particularly to the drawings, a suggested clip structure 10 made in accordance with the teachings of the invention is illustratively shown in FIGS. 1–4. The illustratively shown clip 10 is of a type conventionally employed in the formation of suspenders.

Figure 1:
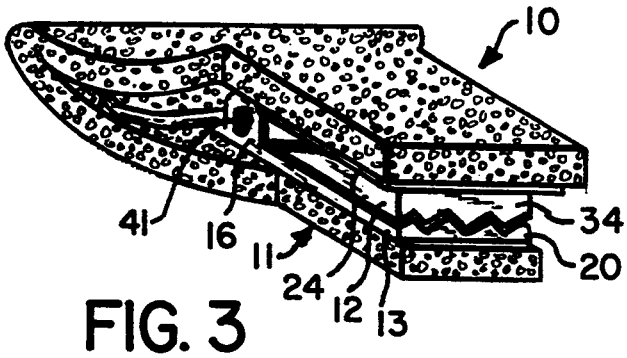
FIG. 1 is a perspective view of a clip made in accordance with the invention with the jaws of the clip shown in a gripping position.

Clip 10 is formed with a lower jaw member 11 preferably stamped of sheet steel or the like, formed of a jaw plate 12 with upstanding side plates 13 and 14. Spaced trunion ears 16 and 17 are formed upstanding from side plates 13 and 14, respectively, along with rear plate 19 on jaw plate 12. Serrated lower jaw teeth 20 is are illustratively shown as formed at the front of and upstanding from jaw plate 12 as best seen in FIG. 1.

Figure 2:
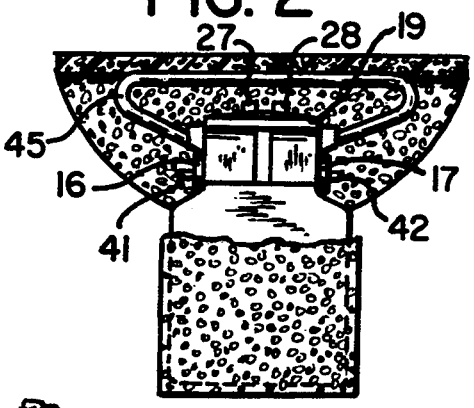
FIG. 2 is top plan view of a clip with the cushioning padding broken away at the handle end of the clip to show the clip handle structure.
Figure 3:
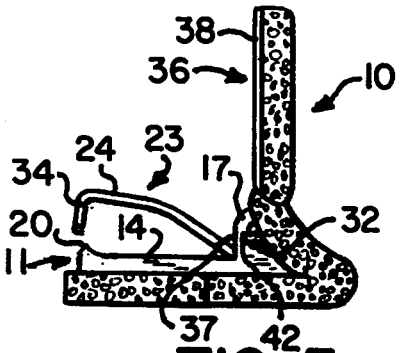
FIG. 3 is a side view of the clip shown in FIG. 1 on a reduced scale with the clip shown in an open position to receive the corner edges of a blanket or comforter and a cover.
Figure 4:
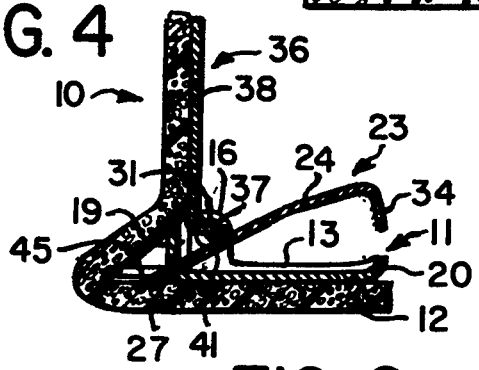
FIG. 4 is a cross-sectional view along a longitudinal axis of the clip on the scale shown in FIG. 3 illustrating the structural details of the clip as presently employed.

An upper jaw member 23 is provided on clip 10 which is preferably stamped of sheet steel formed with upper jaw plate 24 having a pair of spaced rearwardly extending prongs 27 and 28 which which extend through spaced openings in rear plate 19, as best seen in FIGS. 2 and 4, with upper jaw plate 24 extending beneath the pivot openings 31 and 32 in trunion ears 16 and 17. Serrated upper jaw teeth 34, as best seen in FIG. 1, are formed extending downwardly from the front of upper jaw plate 24 as viewed in FIG. 1, with the serrations of upper jaw teeth 34 mating with the serrations of lower jaw teeth 20.

Selectively actuatable jaw biasing means 36 are formed by a lever plate as best seen in FIG. 4 formed of an L-shaped configuration with a relatively short lower pressure leg 37 and an actuating leg 38. Pivot ears 41 and 42 extend from opposite sides of pressure leg 37 and are stamped integrally therewith from sheet metal and extend into the pivot openings 31 and 32, respectively in the assembled clip.

A handle 45 formed of wire shaped as best seen in FIG. 2 is secured to the assembled sheet metal stampings forming lower jaw plate 12, upper jaw plate 24 and clamping lever plate 36, as best seen in FIG. 4. Handle 45 is engaged between the side plates 13 and 14 of lower jaw plate 12 which are brought up with trunion ears 16 and 17 over pivot ears 41 and 42 on lever plate 36 to create the assembled clip.

A cushioning cover 50 is formed in accordance with the invention preferably Of a Cushioning material such as foamed polyurethane, cut preferably by die cutting into a contour such that the cover 50 will completely overlie all exterior surfaces of the clip as best seen in FIG. 1. The cover is preferably provided with a pressure responsive adhesive layer on one face thereof facilitating the securement of the cover 50 on the outer surface of the assembled clip.

OPERATION

Figure 5:
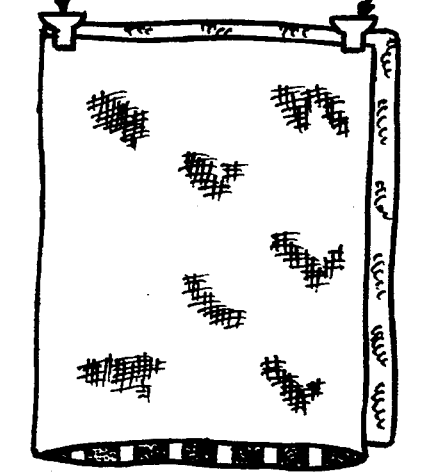
FIG. 5 is a top plan view of a blanket shown superpositioned on an inside out blanket cover with the corners of the closed end of the inside out blanket cover engaged with the corners of the blanket by a clip, the blanket shown in the drawing as laterally displaced to the right with respect to the blanket for purposes of clarity of illustration, it being understood that such displacement is not required or desirable.
Figure 6:
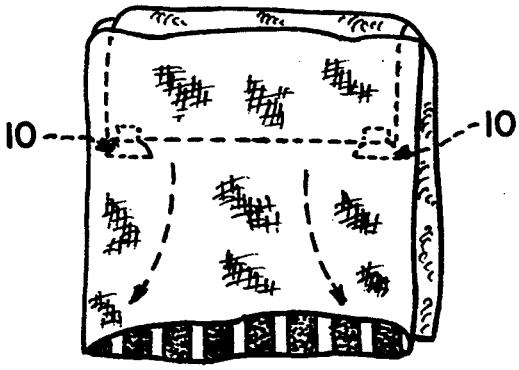
FIG. 6 is a top plan view of the assembled blanket, blanket cover and clip of FIG. 5 showing the blanket cover being drawn right side out over the blanket.
Figure 7:
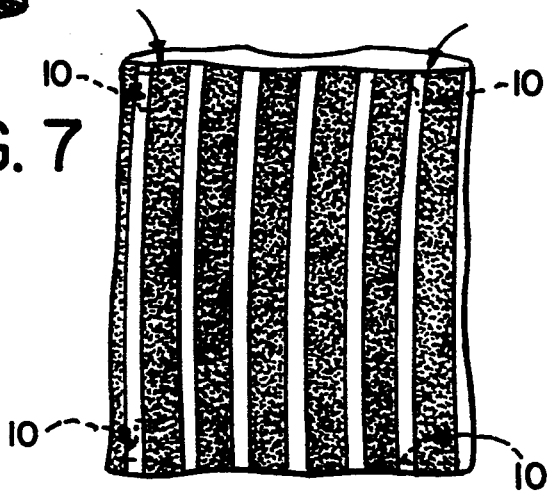
FIG. 7 is top plan view of the assembled cover blanket and clips as arranged for use.

In use, the clip 10 after being assembled as above described is employed to implement the positioning of a cover on a blanket, comforter or the like item of bedding by first turning the cover inside out and spreading it Out so that the bedding item may be positioned over the cover, as best seen in FIG. 5. A padded clip 10 is then secured, one clip at each closed corner of the bag-shaped cover, to grip the Closed corners of the cover and the adjacent corners of the bedding item. Thereafter, the free open end of the cover is drawn down over the clipped corners to turn the bag right side out over the blanket as seen in FIG. 6, until the bedding item is fully enclosed by the cover to the position shown in FIG. 7. If desired, to secure positioning of the free corners of the blanket with respect to the corners of the cover, additional clips 10 may be employed preferably on the interior of the cover to interengage the free blanket and cover corners.

It will be noted that the padded clips now lie within the cover. By virtue of the padding on the clips, the sharpness of the corners and edges of the clips is minimized, and abrasion of the cover by the clip or discomfort to a user is minimized.

As will be apparent to those skilled in the art, the particular form of the clip above described may readily be varied to obtain the results of the described clip and to practice the method of the invention as here described.

The above disclosure has been given by way of illustration and elucidation and not by way of limitation and it is desired to protect all embodiments of the invention within the scope of the appended claims.

What is claimed is:

1. A plurality of clips for securing a cover to an item of bedding, each of said clip comprising:

a lower jaw member is stamped of sheet material to form a jaw plate with upwardly extending serrated teeth on one end thereof;

an upper jaw member is formed of sheet material with a jaw plate having downwardly extending serrated teeth on one end thereof for mating with said teeth of said lower jaw member mounted for relative movement with respect to said lower jaw member;

selectively operable jaw biasing means for bringing said jaw members together to clip any materials positioned therebetween;

and cushioning cover means adhesively secured on the entire outward facing surfaces of said jaw members.

2. A clip as in claim 1 in which said upper jaw member comprises: an upper jaw plate and teeth on one edge of said upper jaw plate; a lower jaw plate; and said lower jaw member comprises a lower jaw plate and teeth on said lower jaw plate teeth mating with the teeth on said upper jaw plate.

3. A clip as in claim 1 in which said cushioning cover is formed of foamed polyurethane.

4. A clip as in claim 1 in which said cushioning cover is formed of a sheet material formed of a dimension such that it is substantially congruent to both said outwardly facing surfaces of said jaw plates, whereby it may be folded to lie over said surfaces.

5. A clip as in claim 4 in which a layer of pressure actuatable adhesive is formed on one surface of said cushioning cover which is positioned over the outward facing surfaces of said jaw plates.

6. A method of enclosing a rectangular in plan view bedding item having four corners, such as a blanket, quilt, comforter or the like in a rectangular bag-like cover formed with corners having an open end and an opposed closed end and dimensioned of a size to enclose the bedding item, said method comprising the steps of:

turning the cover inside out;

positioning the inside out cover with respect to the bedding item so that two corners of the bedding item are in contact with the closed corners of the inside out cover;

applying a clip as set forth in claim 1, one at each of the contacting closed corners of the inside out cover with the adjacent corners of the bedding item to clip the corners of the cover to the corners of the bedding item;

and pulling the open end of the cover down over the bedding item to turn the cover right side out, simultaneously enclosing the bedding item in the cover.

7. A method as in claim 6 in which a pair of clips as in claim 1 are secured to interengage the free corners of the bedding item and the corners of the open end of the cover.

8. A method as in claim 7 in which the clips are applied within the open end of the cover.

* * * * *